US008568840B2

(12) United States Patent
Sawyer et al.

(10) Patent No.: US 8,568,840 B2
(45) Date of Patent: Oct. 29, 2013

(54) BASE FOR TURF SYSTEM

(75) Inventors: Steven Lee Sawyer, Castel San Giovanni (IT); Daniel C Sawyer, Boulder, CO (US); Richard R Runkles, Windsor, CO (US)

(73) Assignee: Brock USA, LLC, Boulder, CO (US)

( * ) Notice: Subject to any disclaimer, the term of this patent is extended or adjusted under 35 U.S.C. 154(b) by 0 days.

(21) Appl. No.: 13/568,611

(22) Filed: Aug. 7, 2012

(65) Prior Publication Data

US 2012/0301638 A1 Nov. 29, 2012

Related U.S. Application Data

(63) Continuation of application No. 12/009,835, filed on Jan. 22, 2008, now Pat. No. 8,236,392.

(60) Provisional application No. 60/881,293, filed on Jan. 19, 2007, provisional application No. 60/927,975, filed on May 7, 2007, provisional application No. 61/000,503, filed on Oct. 26, 2007, provisional application No. 61/003,731, filed on Nov. 20, 2007.

(51) Int. Cl.

| | |
|---|---|
| ***E01C 13/08*** | (2006.01) |
| ***E04C 2/00*** | (2006.01) |
| ***E04C 2/20*** | (2006.01) |
| ***E04C 2/40*** | (2006.01) |

(52) U.S. Cl.
USPC ..... 428/17; 428/53; 428/44; 428/95; 428/131; 428/156; 52/578; 52/581

(58) Field of Classification Search
USPC ..... 428/17, 44, 87, 95, 131, 156, 53, 33, 428/58; 52/581, 578
See application file for complete search history.

(56) References Cited

U.S. PATENT DOCUMENTS

| | | | |
|---|---|---|---|
| 2,515,847 | A | 7/1950 | Winkler |
| 2,746,365 | A | 11/1951 | Dameille |
| 3,438,312 | A | 4/1969 | Becker et al. |
| 3,577,894 | A | 5/1971 | Emerson et al. |
| 3,757,481 | A | 9/1973 | Skinner |
| 3,909,996 | A | 10/1975 | Ettlinger, Jr. et al. |
| 4,146,599 | A | 3/1979 | Lanzetta |
| 4,287,693 | A | 9/1981 | Collette |

(Continued)

FOREIGN PATENT DOCUMENTS

| | | |
|---|---|---|
| BE | 871775 | 5/1979 |
| EP | 1243698 A1 | 9/2002 |

(Continued)

OTHER PUBLICATIONS

European Examination Report, Application No. EP 10 734 609.0 dated Apr. 9, 2013.

(Continued)

*Primary Examiner* — Cheryl Juska
(74) *Attorney, Agent, or Firm* — MacMillian, Sobanski & Todd, LLC

(57) ABSTRACT

An underlayment layer is configured to support an artificial turf assembly. The underlayment layer comprises a core with a top side and a bottom side. The top side has a plurality of spaced apart, upwardly oriented projections that define channels suitable for water flow along the top side of the core when the underlayment layer is positioned beneath an overlying artificial turf assembly.

24 Claims, 11 Drawing Sheets

(56) References Cited

U.S. PATENT DOCUMENTS

| | | | | |
|---|---|---|---|---|
| 4,405,665 | A * | 9/1983 | Beaussier et al. | 428/17 |
| 4,445,802 | A | 5/1984 | Loov | |
| 4,629,358 | A | 12/1986 | Springston et al. | |
| 4,637,942 | A * | 1/1987 | Tomarin | 428/17 |
| 4,727,697 | A | 3/1988 | Vaux | |
| 5,044,821 | A | 9/1991 | Johnsen | |
| 5,102,703 | A | 4/1992 | Colonel et al. | |
| 5,292,130 | A | 3/1994 | Hooper | |
| 5,342,141 | A | 8/1994 | Close | |
| 5,363,614 | A | 11/1994 | Faulkner | |
| 5,383,314 | A | 1/1995 | Rothberg | |
| 5,460,867 | A | 10/1995 | Magnuson et al. | |
| 5,514,722 | A | 5/1996 | DiGeronimo | |
| 5,888,614 | A | 3/1999 | Slocum et al. | |
| 5,916,034 | A | 6/1999 | Lancia | |
| 5,920,915 | A | 7/1999 | Bainbridge et al. | |
| 5,957,619 | A | 9/1999 | Kinoshita et al. | |
| 6,032,300 | A | 3/2000 | Bainbridge et al. | |
| 6,055,676 | A | 5/2000 | Bainbridge et al. | |
| 6,098,209 | A | 8/2000 | Bainbridge et al. | |
| 6,301,722 | B1 | 10/2001 | Nickerson et al. | |
| 6,357,054 | B1 | 3/2002 | Bainbridge et al. | |
| 6,453,477 | B1 | 9/2002 | Bainbridge et al. | |
| 6,616,542 | B1 | 9/2003 | Reddick | |
| 6,740,387 | B1 * | 5/2004 | Lemieux | 428/95 |
| 6,796,096 | B1 | 9/2004 | Heath | |
| 6,802,669 | B2 | 10/2004 | Ianniello et al. | |
| 6,877,932 | B2 | 4/2005 | Prevost | |
| 7,014,390 | B1 * | 3/2006 | Morris | 405/50 |
| 7,114,298 | B2 | 10/2006 | Kotler | |
| 7,131,788 | B2 | 11/2006 | Ianniello et al. | |
| 7,244,076 | B2 | 7/2007 | Whitson | |
| 7,244,477 | B2 | 7/2007 | Sawyer et al. | |
| 7,273,642 | B2 * | 9/2007 | Prevost | 428/17 |
| 7,487,622 | B2 | 2/2009 | Wang | |
| 7,516,587 | B2 | 4/2009 | Barlow | |
| 7,563,052 | B2 | 7/2009 | Van Reijen | |
| 7,587,865 | B2 | 9/2009 | Moller, Jr. | |
| 7,645,501 | B2 | 1/2010 | Sawyer et al. | |
| 7,662,468 | B2 | 2/2010 | Bainbridge | |
| 7,722,287 | B2 | 5/2010 | Swank | |
| 7,722,288 | B2 * | 5/2010 | Prevost et al. | 405/45 |
| 7,771,814 | B2 | 8/2010 | Grimble et al. | |
| 7,900,416 | B1 | 3/2011 | Yokubison et al. | |
| D637,318 | S | 5/2011 | Sawyer et al. | |
| 7,955,025 | B2 * | 6/2011 | Murphy et al. | 404/35 |
| D645,169 | S | 9/2011 | Runkles | |
| 8,109,050 | B2 | 2/2012 | Ovaert | |
| 8,221,856 | B2 | 7/2012 | Stroppiana | |
| 8,225,566 | B2 * | 7/2012 | Prevost et al. | 52/302.1 |
| 8,236,392 | B2 * | 8/2012 | Sawyer et al. | 428/17 |
| 8,341,896 | B2 | 1/2013 | Moller, Jr. et al. | |
| 8,353,640 | B2 * | 1/2013 | Sawyer | 404/4 |
| 2001/0002497 | A1 | 6/2001 | Scuero | |
| 2001/0048849 | A1 | 12/2001 | Rinninger | |
| 2003/0020057 | A1 | 1/2003 | Sciandra | |
| 2003/0039511 | A1 | 2/2003 | Prevost | |
| 2003/0223826 | A1 | 12/2003 | Ianniello | |
| 2004/0058096 | A1 * | 3/2004 | Prevost | 428/17 |
| 2005/0028475 | A1 | 2/2005 | Barlow et al. | |
| 2005/0042394 | A1 | 2/2005 | Sawyer et al. | |
| 2006/0032170 | A1 | 2/2006 | Vershum et al. | |
| 2006/0081159 | A1 | 4/2006 | Chapman et al. | |
| 2006/0141231 | A1 | 6/2006 | Lemieux | |
| 2007/0166508 | A1 * | 7/2007 | Waterford | 428/90 |
| 2008/0176010 | A1 | 7/2008 | Sawyer et al. | |
| 2008/0216437 | A1 * | 9/2008 | Prevost et al. | 52/589.1 |
| 2008/0219770 | A1 * | 9/2008 | Prevost et al. | 405/50 |
| 2008/0240860 | A1 * | 10/2008 | Ianniello | 405/53 |
| 2009/0094918 | A1 * | 4/2009 | Murphy et al. | 52/387 |
| 2009/0162579 | A1 | 6/2009 | McDuff | |
| 2009/0188172 | A1 | 7/2009 | Duharme et al. | |
| 2009/0208674 | A1 | 8/2009 | Murphy et al. | |
| 2009/0232597 | A1 | 9/2009 | Zwier et al. | |
| 2009/0325720 | A1 | 12/2009 | Chapman | |
| 2010/0041488 | A1 * | 2/2010 | Foxon et al. | 472/92 |
| 2010/0104778 | A1 * | 4/2010 | Wise | 428/17 |
| 2010/0173116 | A1 | 7/2010 | Bainbridge | |
| 2010/0239790 | A1 * | 9/2010 | Stricklen et al. | 428/17 |
| 2010/0279032 | A1 | 11/2010 | Chereau et al. | |
| 2010/0284740 | A1 * | 11/2010 | Sawyer et al. | 404/70 |

FOREIGN PATENT DOCUMENTS

| | | | |
|---|---|---|---|
| FR | 2616655 | A | 12/1988 |
| GB | 1378494 | | 12/1974 |
| JP | 54032371 | U | 3/1979 |
| JP | 03197703 | A * | 8/1991 |
| JP | 7-137189 | | 5/1995 |
| JP | 8049209 | A | 2/1996 |
| JP | 2000-034823 | | 2/2000 |
| JP | 2006130288 | | 5/2006 |
| KR | 881167 | B1 * | 2/2009 |
| KR | 2012004054 | U * | 6/2012 |
| NL | 1004405 | C1 | 2/1997 |
| WO | 9856993 | | 12/1998 |
| WO | 9926784 | A | 6/1999 |
| WO | 9928557 | | 6/1999 |
| WO | 02/09825 | A1 | 2/2002 |
| WO | 02075053 | A1 | 9/2002 |
| WO | 03/000994 | A1 | 1/2003 |
| WO | 2004/011724 | A1 | 2/2004 |
| WO | 2006116450 | A2 | 11/2006 |
| WO | 2007/002442 | A1 | 1/2007 |
| WO | 2008011708 | A1 | 1/2008 |

OTHER PUBLICATIONS

European Search Report, 10195632.4, dated Apr. 12, 2012.
European Search Report, 10195633.2, dated Apr. 12, 2012.
Aero-Spacer Dri-Lex, Hydrofil, FaytexCorp.
Dynamic Cushioning Performance, JSP International, 1998.
Quiet Walk, Midwest Padding, www.midwestpadding.com/quietwalk/lintro.html, Jul. 24, 2003.
Silent Walk, The Silent Partner in Laiminating Flooring, www.sponge-cushion.com/silent2.htm, Jul. 24, 2003.
Tuplex—General—underlay, flooring underlay, parquet underlay, Tuplex Corp., www.snt-group.net/tuplex/usa/corp.htm., Jul. 24, 2003.
Porex Porous Plastics High Performance Materials, Porex Technologies, 1989.
Product Samples, The engineered plastic foams of JSP International, JSP International, www.jspi.com.
Cork Underlayment—Rolls & Sheets, www.ecobydesign.com/shop/cork/cork_underlayment.html., Jul. 24, 2003.

* cited by examiner

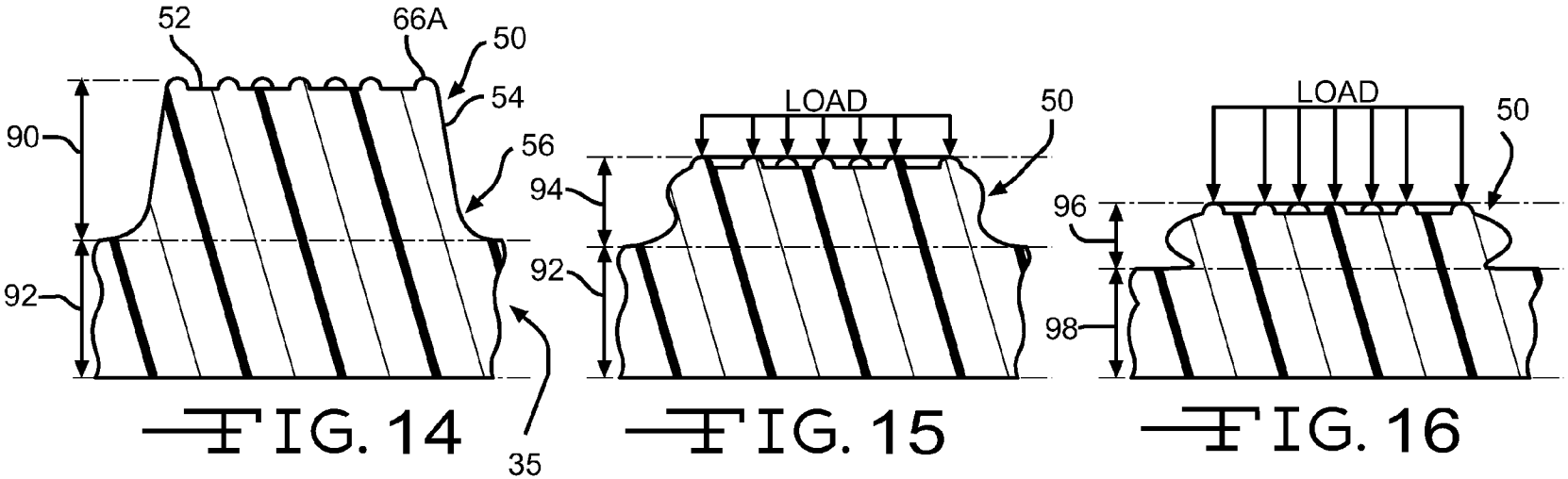
FIG. 14
FIG. 15
FIG. 16
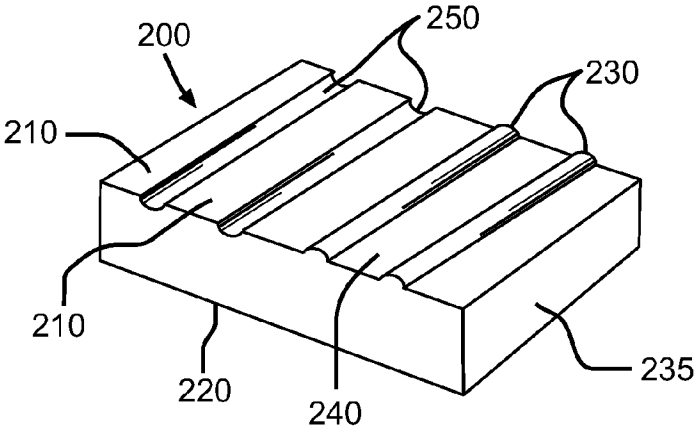
FIG. 17

BASE FOR TURF SYSTEM

CROSS-REFERENCE TO RELATED APPLICATIONS

This application is a Continuation Application of U.S. patent application Ser. No. 12/009,835, filed Jan. 22, 2008, now U.S. Pat. No. 8,236,392, issued Aug. 7, 2012, which claims the benefit of U.S. Provisional Application No. 60/881,293, filed Jan. 19, 2007; U.S. Provisional Application No. 60/927,975, filed May 7, 2007; U.S. Provisional Application No. 61/000,503, filed Oct. 26, 2007; and U.S. Provisional Application No. 61/003,731, filed Nov. 20, 2007, the disclosures of which are incorporated herein by reference.

TECHNICAL FIELD

This invention relates in general to artificial turf systems of the type used in athletic fields, ornamental lawns and gardens, and playgrounds.

BACKGROUND OF THE INVENTION

Artificial turf systems are commonly used for sports playing fields and more particularly to artificial playing fields. Artificial turf systems can also be used for synthetic lawns and golf courses, rugby fields, playgrounds, and other similar types of fields or floor coverings. Artificial turf systems typically comprise a turf assembly and a foundation, which can be made of such materials as asphalt, graded earth, compacted gravel or crushed rock. Optionally, an underlying resilient base or underlayment layer may be disposed between the turf assembly and the foundation. The turf assembly is typically made of strands of plastic artificial grass blades attached to a turf backing. An infill material, which typically is a mixture of sand and ground rubber particles, may be applied among the vertically oriented artificial grass blades, typically covering the lower half or ⅔ of the blades.

SUMMARY OF THE INVENTION

This invention relates to a turf underlayment layer configured to support an artificial turf assembly. The turf underlayment layer has panels including edges that are configured to interlock with the edges of adjacent panels to form a vertical interlocking connection. The interlocking connection is capable of substantially preventing relative vertical movement of one panel with respect to an adjacent connected panel. The underlayment comprises a core with a top side and a bottom side. The top side has a plurality of spaced apart, upwardly oriented projections that define channels suitable for water flow along the top side of the core when the underlayment layer is positioned beneath an overlying artificial turf assembly.

The top side may include an upper support surface in contact with the artificial turf assembly. The upper support surface, in turn, may have a plurality of channels configured to allow water flow along the top side of the core. The upper support surfaces may be substantially flat. The bottom side may include a lower support surface that is in contact with a foundation layer and also have a plurality of channels configured to allow water flow along the bottom side of the core. A plurality of spaced apart drain holes connects the upper support surface channels with the lower support surface channels to allow water flow through the core.

The plurality of spaced apart projections on the top side are deformable under a compressive load. The projections define a first deformation characteristic associated with an athletic response characteristic and the core defines a second deformation characteristic associated with a bodily impact characteristic. The first and second deformation characteristics are complimentary to provide a turf system bodily impact characteristic and a turf system athletic response characteristic.

A method of assembling an underlayment layer to an adjacent underlayment layer includes providing a first underlayment layer on top of a substrate. The underlayment layer has at least one edge with a top side flap, a bottom side flap, and a flap assembly groove disposed therebetween. A second underlayment layer is positioned adjacent to the first underlayment layer and on top of the substrate. The second underlayment layer also ahs at least one edge with a top side flap, a bottom side flap, and a flap assembly groove disposed therebetween. The first underlayment layer top side flap is deflected in an upward direction between a corner and the flap assembly groove. The second underlayment layer bottom side flap is inserted under the upwardly deflected first underlayment layer top side flap. Finally, the first underlayment layer top side flap is downwardly deflected into engagement with the second underlayment layer bottom side flap.

Various aspects of this invention will become apparent to those skilled in the art from the following detailed description of the preferred embodiment, when read in light of the accompanying drawings.

BRIEF DESCRIPTION OF THE DRAWINGS

FIG. 14 is a cross-sectional view in elevation of an underlayment panel showing projections in a free-state, unloaded condition.

FIG. 15 is a cross-sectional view in elevation of the underlayment panel of FIG. 14 showing the deflection of the projections under a vertical load.

FIG. 16 is a cross-sectional view in elevation of the underlayment panel of FIG. 15 showing the deflection of the projections and panel core under an increased vertical load.

FIG. 17 is a perspective view of a panel with spaced apart friction members configured to interact with downwardly oriented ridges on the artificial turf assembly.

DETAILED DESCRIPTION OF THE PREFERRED EMBODIMENT

Figure 1:
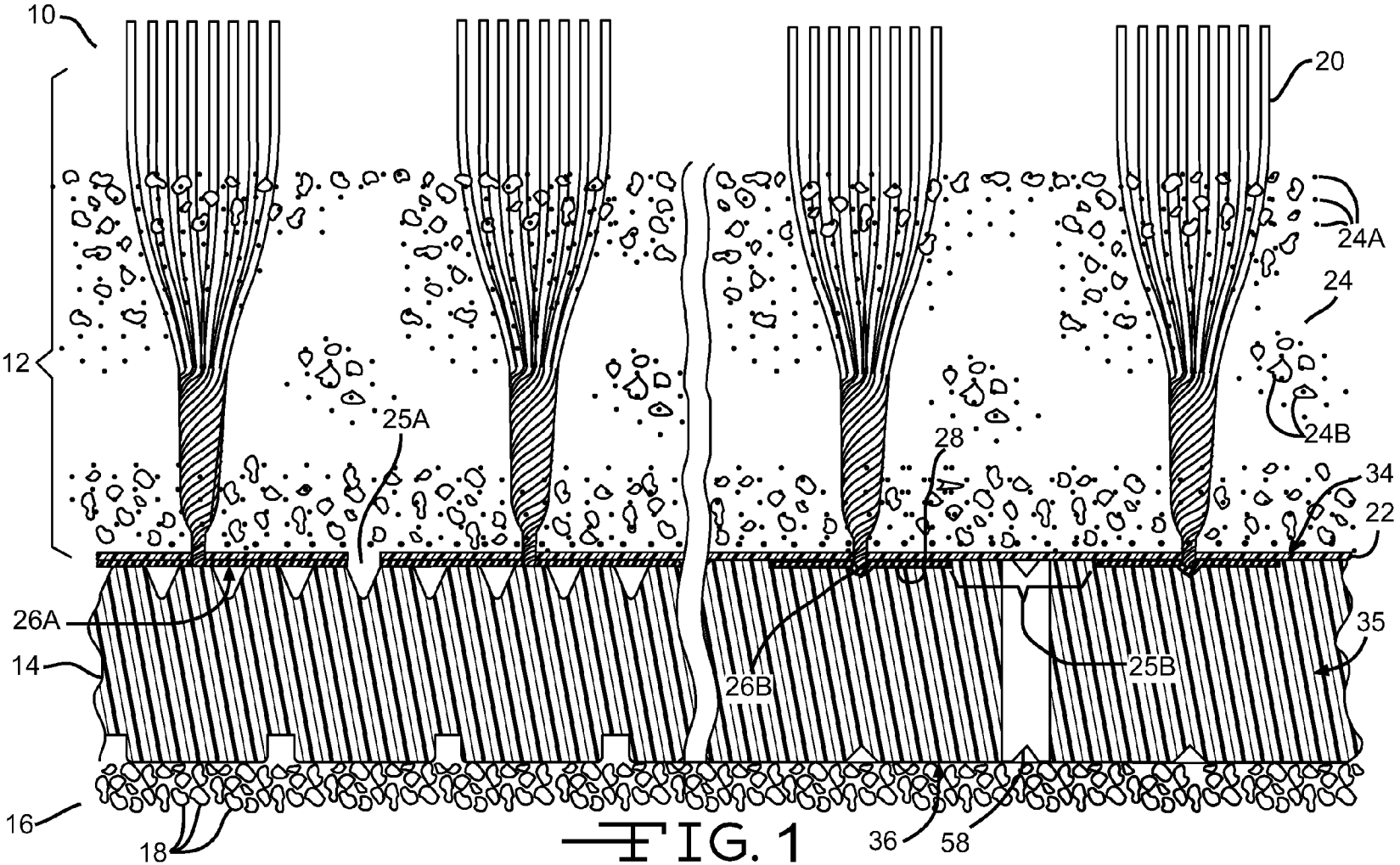
FIG. 1 is a schematic cross-sectional view in elevation of an artificial turf system.

The turf system shown in FIG. 1 is indicated generally at 10. The turf system includes an artificial turf assembly 12, an underlayment layer 14 and a foundation layer 16. The foundation layer 16 can comprise a layer 18 of crushed stone or aggregate, or any other suitable material. Numerous types of foundation layers are known to those skilled in the art. The crushed stone layer 18 can be laid on a foundation base, such as compacted soil, a poured concrete base, or a layer of asphalt paving, not shown. Alternatively, the underlayment layer 14 may be applied over the asphalt or concrete base, omitting the crushed stone layer, if so desired. In many turf systems used for an athletic field, the foundation layers are graded to a contour such that water will drain to the perimeter of the field and no water will pool anywhere on the surface.

The artificial turf assembly 12 includes strands of synthetic grass blades 20 attached to a turf backing 22. An optional infill material 24 may be applied to the grass blades 20. The synthetic grass blades 20 can be made of any material suitable for artificial turf, many examples of which are well known in the art. Typically the synthetic grass blades are about 5 cm in length although any length can be used. The blades 20 of artificial grass are securely placed or tufted onto the backing 22. One form of blades that can be used is a relatively wide polymer film that is slit or fibrillated into several thinner film blades after the wide film is tufted onto the backing 22. In another form, the blades 20 are relatively thin polymer films (monofilament) that look like individual grass blades without being fibrillated. Both of these can be colored to look like blades of grass and are attached to the backing 22.

The backing layer 22 of the turf assembly 12 is typically water-porous by itself, but is often optionally coated with a water-impervious coating 26A, such as for example urethane, for dimensional stability of the turf. In order to allow water to drain vertically through the backing 22, the backing can be provided with spaced apart holes 25A. In an alternative arrangement, the water impervious coating is either partially applied, or is applied fully and then scraped off in some portions, such as drain portion 25B, to allow water to drain through the backing layer 22. The blades 20 of grass fibers are typically tufted onto the backing 22 in rows that have a regular spacing, such as rows that are spaced about 2 centimeters to about 4 centimeters apart, for example. The incorporation of the grass fibers 20 into the backing layer 22 sometimes results in a series of spaced apart, substantially parallel, urethane coated corrugations or ridges 26B on the bottom surface 28 of the backing layer 22 formed by the grass blade tufts. Ridges 26B can be present even where the fibers are not exposed.

The optional infill material 24 of the turf assembly 12, when applicable, is placed in between the blades 20 of artificial grass and on top of the backing 22. If the infill material 24 is applied, the material volume is typically an amount that covers only a bottom portion of the synthetic grass blades 20 so that the top portions of the blades stick out above the infill material 24. The typical purpose of the optional infill material 24 is to add stability to the field, improve traction between the athlete's shoe and the play surface, and to improve shock attenuation of the field. The infill material 24 is typically sand 24A or ground up rubber particles or synthetic particulate 24B or mixtures of these, although other materials can be used.

When the backing layer 22 has holes 25A or a porous section 25B for water drainage, then some of the infill material 24 is able to wash through the backing layer porous section 25B or the backing layer drainage holes 25A and onto the turf underlayment layer 14. This infill migration, or migration of the infill constituents, is undesirable because the depletion of the infill material 24 results in a field that doesn't have the initially designed stability and firmness characteristics. Excessive migration of the infill material 24, or the infill constituent components, to the turf underlayment layer 14 can create a hard layer which makes the whole system less able to absorb impacts.

The turf underlayment layer 14 is comprised of expanded polyolefin foam beads, which can be expanded polypropylene (EPP) or expanded polyethylene (EPE), or any other suitable material. The foam beads are closed cell (water impervious) beads. In one optional method of manufacture, the beads are originally manufactured as tiny solid plastic pellets, which are later processed in a controlled pressure chamber to expand them into larger foam beads having a diameter within the range of from about 2 millimeters to about 5 millimeters. The foam beads are then blown into a closed mold under pressure so they are tightly packed. Finally, steam is used to heat the mold surface so the beads soften and melt together at the interfaces, forming the turf underlayment layer 14 as a solid material that is water impervious. Other methods of manufacture can be used, such as mixing the beads with an adhesive or glue material to form a slurry. The slurry is then molded to shape and the adhesive cured. The slurry mix underlayment may be porous through the material thickness to drain water away. This porous underlayment structure may also include other drainage feature discussed below. The final EPP material can be made in different densities by starting with a different density bead, or by any other method. The material can also be made in various colors. The resulting underlayment structure, made by either the steam molding or the slurry mixing processes, may be formed as a water impervious underlayment or a porous underlayment. These resulting underlayment layer structures may further include any of the drainage, deflection, and interlocking features discussed below.

Alternatively, the turf underlayment layer 14 can be made from a molding and expansion of small pipe sections of foamed material, similar to small foamed macaroni. The small pipe sections of foamed material are heated and fused together in the mold in the same way as the spherical beads. The holes in the pipe sections keep the underlayment layer from being a totally solid material, and some water can drain through the underlayment layer. Additionally, varying the hollow section geometry may provide an ability to vary the material density in order to selectively adjust the performance of the turf system.

Figure 2:
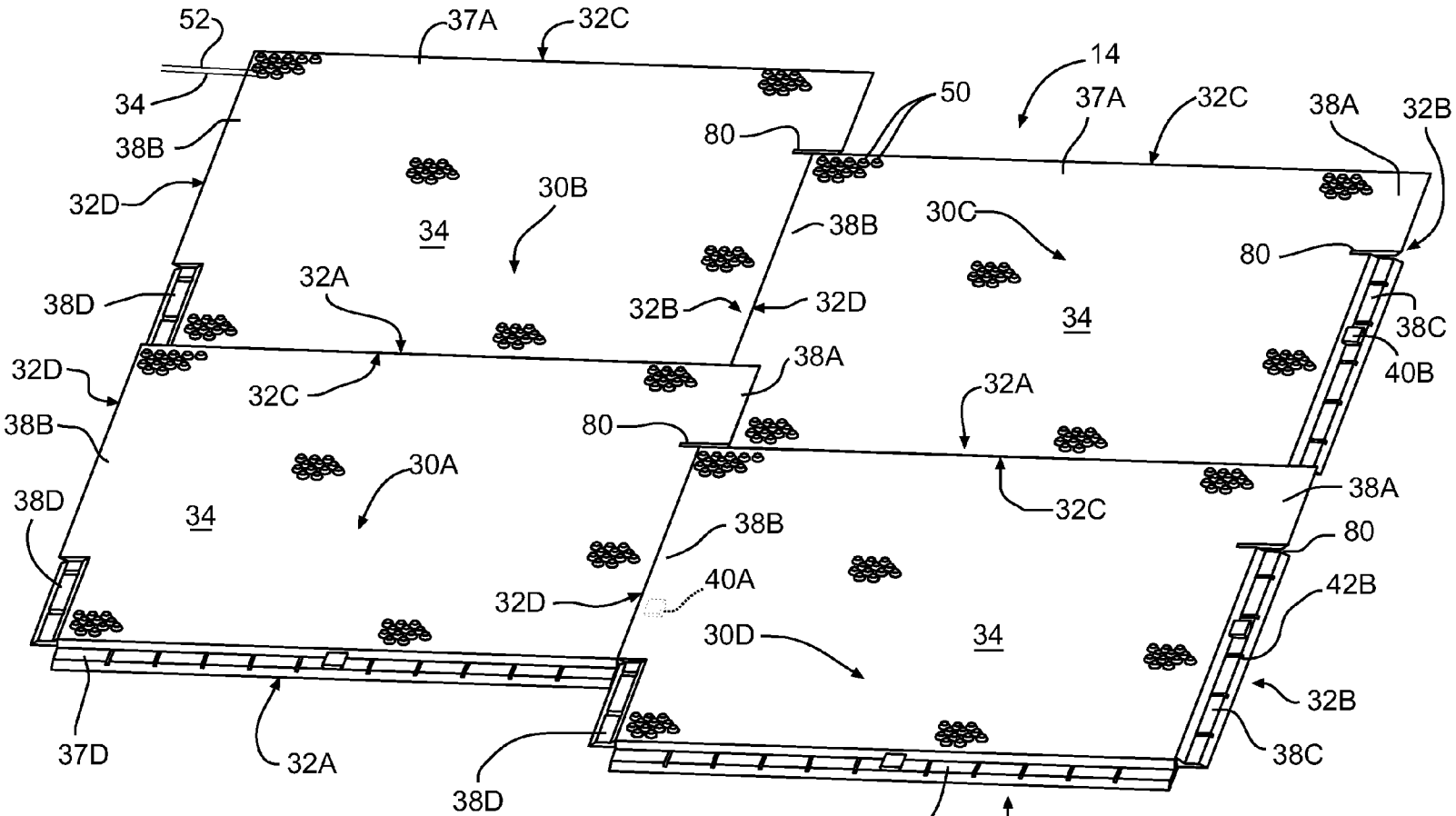
FIG. 2 is a schematic perspective view of an embodiment of an underlayment panel assembly.
Figure 2A:
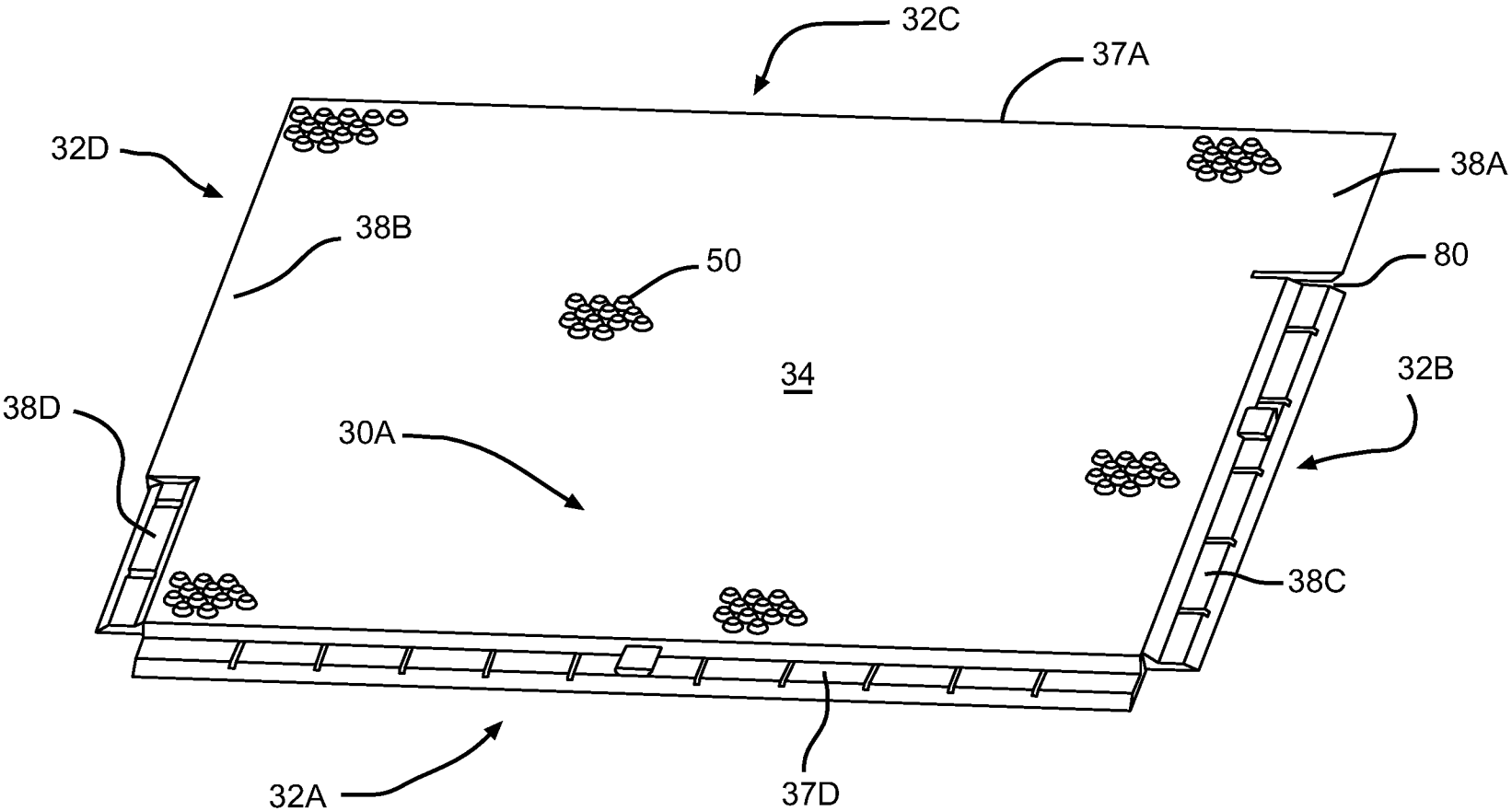
FIG. 2A is an enlarged, perspective view of an underlayment panel of the panel assembly of FIG. 2.
Figure 3:
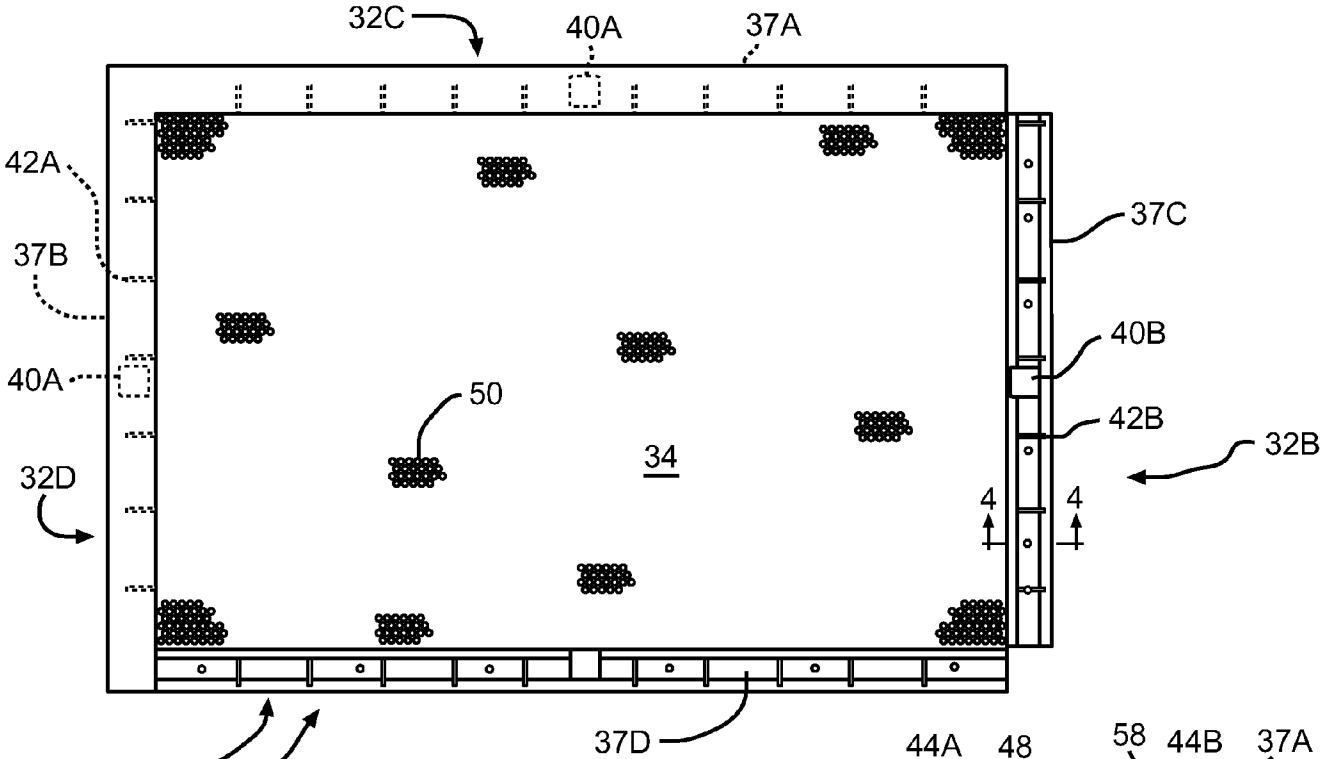
FIG. 3 is an enlarged plan view of an alternative embodiment of an underlayment panel.

In the embodiment illustrated in FIG. 2, the turf underlayment layer 14 is comprised of a plurality of underlayment panels 30A, 30B, 30C, and 30D. Each of the panels have similar side edges 32A, 32B, 32C, and 32D. The panels further have substantially planar major faces, i.e., top sides 34 and bottom sides 36. The substantially flat planar faces, top sides 34 and bottom sides 36, define a core 35 therebetween. There are flaps 37, 38 and fittings 40, indicated generally, are arranged along the edges 32A-D as shown. In one embodiment shown in FIGS. 2 and 2A, the flaps 37 and 38 are configured to include top side flaps 37A, 38A, 38B and bottom side flaps 37D, 38C, 38D. For reference purposes only, top side flaps 38A and 38B are shown in FIGS. 2 and 2A as having a patterned surface contiguous with, the top side 34. Likewise, FIG. 3 shows the top side flaps 37A and 37B of panel 30A-D having a substantially flat surface adjacent to an upper support surface 52 that supports the backing layer 22 of the turf assembly 12. Alternatively, the top side flaps 37A, 37B, 38A and 38B can have either a substantially flat surface adjacent to, or a patterned surface contiguous with, the top side 34. Bottom side flaps are similarly associated with the bottom side 36 or a lower support surface 70 of the panels 30 contacting the underlying strata, such as the foundation layer 16.

The top side flap 38A may be of unequal length relative to the adjacent bottom side flap 38C, as shown positioned along edge 32B in FIGS. 2 and 2A. Alternatively, for example, the top side flap 38A and the bottom side flap 38C, positioned along the edge 32B, may be of equal length. In FIG. 2, the panels 30A-D further show edges 32A and 32C having substantially continuous top side flaps 37A and bottom side flaps 37D, respectively, though such a configuration is not required. The edges 32A and 32C may have flaps similarly configured to edges 32B and 32D. As shown in FIG. 3, the top side flap 37A may extend along the length of the edge 32C and the bottom side flap 38C may extend along the oppositely positioned edge 32A.

Figure 6:
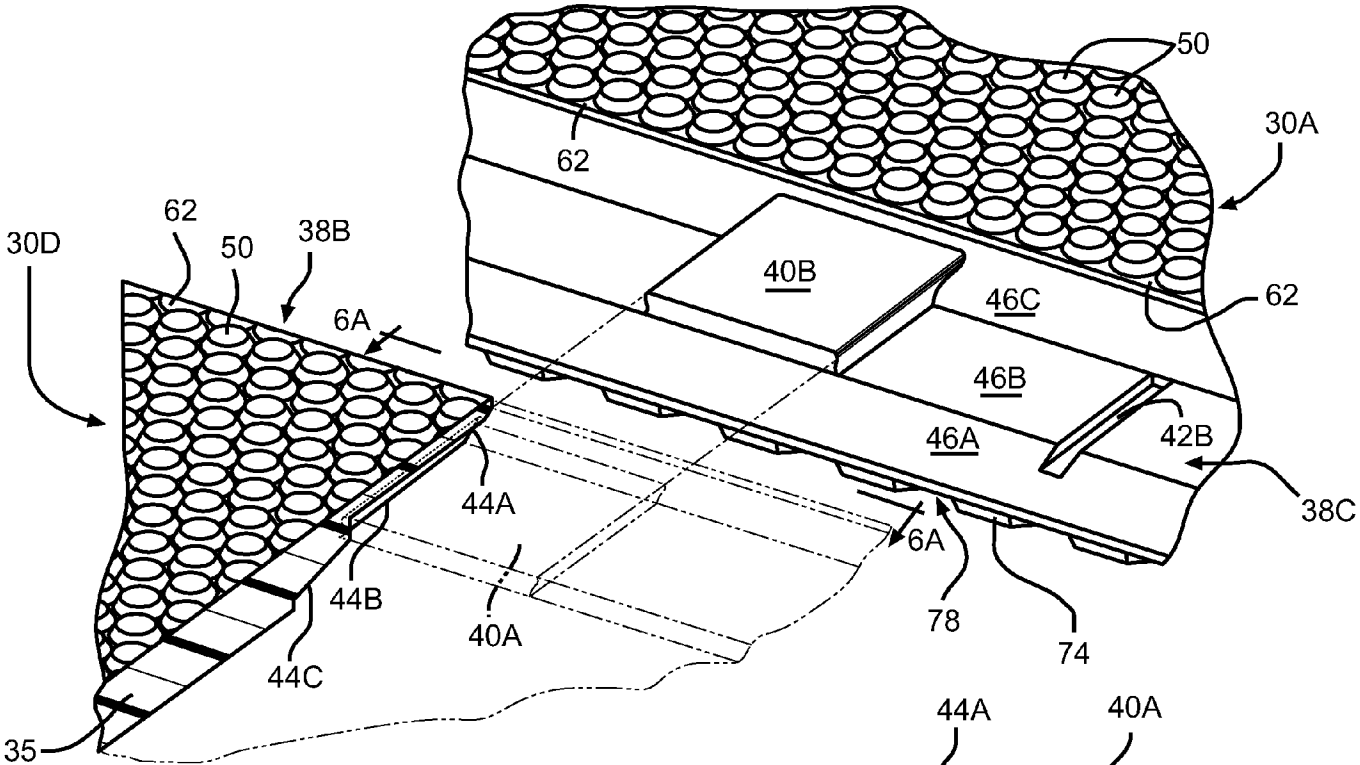
FIG. 6 is a schematic perspective view of the assembly of the interlocking edges of adjacent underlayment panels.
Figure 6A:
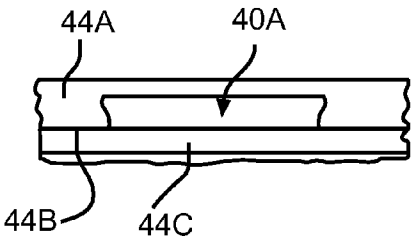
FIG. 6A is a schematic plan view of the interlocking edge of FIG. 6.

When assembled, the flaps along edges 32A and 32B are configured to interlock with the mating edges 32C and 32D, respectively. The top side flap 38A and adjacent bottom side flap 38C overlap and interlock with the mating bottom side flap 38D and top side flap 38 B, respectively. The recessed fitting 40A of top side flap 38B, of panel 30D interlocks with the projecting fitting 40B of panel 30A, as shown in FIGS. 2 and 6. In an alternative embodiment, the surface of the projecting fitting 40B may extend up to include the projections 50. In this embodiment, the mating recessed fitting 40A of the top side flap 38B has a corresponding void or opening to receive the projected fitting 40B. These mating flaps 37, 38 and fittings 40 form a vertical and horizontal interlock connection, with the flaps 38A and 38B being positioned along flaps 38D and 38 C, respectively, substantially preventing relative vertical movement of one panel with respect to an adjacent connected panel. The projecting and recessed fittings 40A and 40B, respectively, substantially prevent horizontal shifts between adjacent panels 30 due to mechanically applied shear loads, such as, for example, from an athlete's foot or groundskeeping equipment.

In one embodiment, the vertical interlock between adjacent panels 30 is sufficient to accommodate heavy truck traffic, necessary to install infill material, without vertical separation of the adjacent panels. The adjacent top side flaps 38A and 38B and adjacent bottom side flaps 38C and 38D also substantially prevent horizontal shifting of the panels due to mechanically applied shear loads. The cooperating fittings 40A and 40B, along with adjacent flaps 38A, 38B and 38C, 38D, provide sufficient clearance to accommodate deflections arising from thermal expansion. The flaps 38 may optionally include drainage grooves 42B and drainage ribs or projections 42A that maintain a drainage channel between the mated flaps 38A-D of adjoining panels, as will be discussed below. The drainage projections 42A and the drainage grooves 42B may be oriented on mated flaps of adjacent panels in an offset relative relationship, in a cooperatively engaged relationship, or applied to the mated flaps 38A-D as either solely projections or grooves. When oriented in a cooperating engaged relationship, these projections 42A and grooves 42B may additionally supplement the in-plane shear stability of the mated panel assemblies 30 when engaged together. The drainage projections 42A and drainage grooves 42B may be equally or unequally spaced along the flaps 38A and 38B, respectively, as desired.

Optionally, the drainage grooves 42B and projections 42A can perform a second function, i.e. a retention function. The turf underlayment 30 may include the cooperating drainage ribs or projections 42A and grooves 42B for retention purposes, similar to the fittings 40. The projections 42A and fittings 40B may include various embodiments of differently shaped raised recessed structures, such as square, rectangular, triangular, pyramidal, trapezoidal, cylindrical, frusto-conical, helical and other geometric configurations that may include straight sides, tapering sides or reversed tapering sides. These geometric configurations cooperate with mating recesses, such as groove 42B and recessed fitting 40A having complementary geometries. The cooperating fittings, and optionally the cooperating projections and grooves, may have dimensions and tolerances that create a variety of fit relationships, such as loose fit, press fit, snap fit, and twist fit connections. The snap fit relationship may further provide an initial interference fit, that when overcome, results in a loose or line-to-line fit relationship. The twist fit relationship may include a helical surface on a conical or cylindrical projection that cooperates with a recess that may or may not include a corresponding helical surface. The press fit, snap fit, and twist fit connections may be defined as positive lock fits that prevent or substantially restrict relative horizontal movement of adjacent joined panels.

The drainage projections 42A and grooves 42B, either alone or in a cooperating relationship, may provide a vertically spaced apart relationship between the mating flaps 38A-D, or a portion of the mating flaps 38A-D, of adjoining panels to facilitate water drainage away from the top surface 34. Additionally, the drainage projections 42A and grooves 42B may provide assembled panels 30 with positioning datums to facilitate installation and accommodate thermal expansion deflections due to environmental exposure. The projections 42A may be either located in, or offset from, the grooves 42B. Optionally, the edges 32A-D may only include one of the projections 42A or the grooves 42B in order to provide increased drainage. Not all panels may need or require projections 42A and grooves 42B disposed about the outer perimeter. For example, it may be desired to produce specific panels that include at least one edge designed to abut a structure that is not a mating panel, such as a curb, trim piece, sidewalk, and the like. These panels may have a suitable edge, such as a frame, flat end, rounded edge, point, and the like, to engage or abut the mating surface. For panels that mate with adjacent panels, each panel may include at least one projections along a given edge and a corresponding groove on an opposite side, positioned to interact with a mating projection to produce the required offset.

Figure 4:
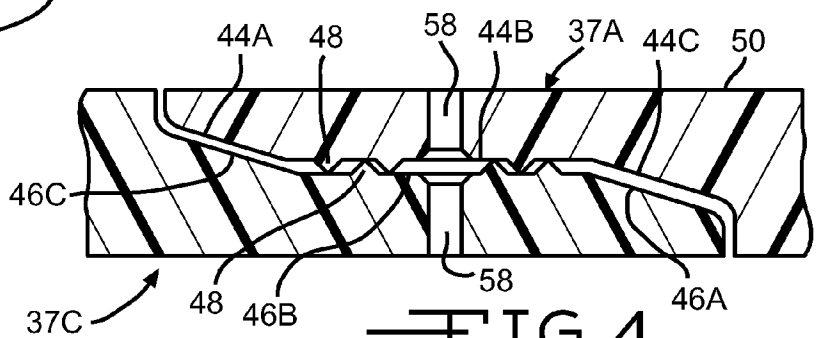
FIG. 4 is an enlarged cross sectional view, in elevation, of the interlocking edge of the underlayment panel of FIG. 3 and an adjacent mated underlayment panel.

FIG. 4 illustrates an embodiment of a profile of cooperating flaps 38A and 38C. The profiles of flaps 38A and 38C include complimentary mating surfaces. The top side flap 38A includes a leading edge bevel 44A, a bearing shelf 44B and a back bevel 44C. The bottom side flap 38C includes a leading edge bevel 46A configured to be positioned against back bevel 44C. Likewise, a bearing shelf 46B is configured to contact against the bearing shelf 44B and the back bevel 46C is positioned against the leading edge bevel 44A. The bearing shelves 44B and 46B may optionally include ribs 48 extending longitudinally along the length of the respective flaps. The ribs 48 may be a plurality of outwardly projecting ribs that cooperate with spaces between adjacent ribs of the mating flap. Alternatively, the top side flap 38A may have outwardly projecting ribs 48 and the bottom side flap 38C may include corresponding recesses (not shown) of a similar shape and location to cooperatively engage the ribs 38. Additionally, drain holes 58 may extend through the flaps 38 to provide water drainage, as will be described below.

Figure 5:
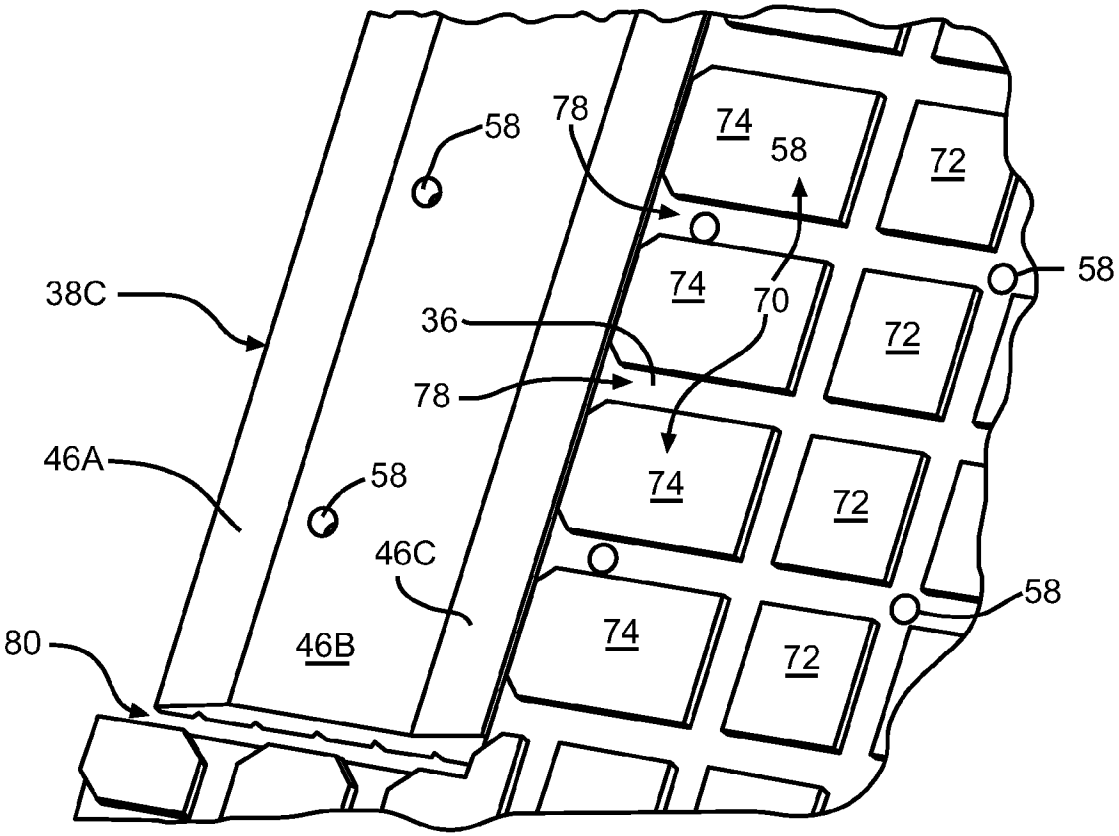
FIG. 5 is an enlarged view of an embodiment of an interlocking edge and bottom side projections of the underlayment panel.

Referring to FIGS. 2, 2A, and 5, a flap assembly groove 80 is shown positioned between the top side flap 38A and the bottom side flap 38C. The flap assembly groove 80, however, may be positioned between any adjacent interlocking geometries. The groove 80 allows relative movement of adjacent flaps on an edge of a panel so that adjoining panel flaps can be assembled together more easily. When installing conventional panels, adjoining panels are typically slid over the compacted base and twisted or deflected to position the adjoining interfaces together. As the installers attempt to mate adjoining prior art panel interfaces together, they may bend and bow the entire panel structure to urge the mating sections into place. The corners and edges of these prior art panels have a tendency to dig into the compacted base causing discontinuities which is an undesirable occurrence.

In contrast to the assembly of prior art panels, the grooves 80 of the panels 30A, 30B, 30C, and 30D allow the top side flap 38A to flex relative to bottom side flap 38C. To illustrate the assembly method, panels 30A, 30B and 30D are relatively positioned in place and interlocked together on the foundation layer. To install panel 30C, the top side flap 38A of panel 30A is deflected upwardly. Additionally, the mated inside corner of panels 30A and 30 D may be slightly raised as an assembled unit. The area under the top side flap 38A of panel 30A is exposed in order to position the mating bottom side flap 38D. The bottom side flap 37D positioned along edge 32A of panel 30A may be positioned under the top side flap 37A on edge 32C of panel 30D. This positioning may be aided by slightly raising the assembled corner of panels 30A and 30D. The positioned flaps may be engaged by a downward force applied to the overlapping areas. By bending the top side flaps of a panel up during assembly, access to the mating bottom side flap location increases thus facilitating panel insertion without significant sliding of the panel across the compacted foundation layer. This assembly technique prevents excessively disrupting the substrate or the previously installed panels. The assembly of panels 30A-D, shown in FIG. 2, may also be assembled by starting with the panel 30C, positioned in the upper right corner. Subsequent top side flaps along the edges 32 may be placed over the bottom side flaps already exposed.

FIG. 2 illustrates an embodiment of assembled panels 30 where the top side flap 38A is shorter than the bottom side flap 38B, as described above, creating a flap offset. The flap offset aligns the panels 30 such that seams created by the mating edges 32 do not line up and thereby create a weak, longitudinal deflection point. The top side and bottom side flaps may be oriented in various offset arrangements along the edge 32. For example, two top side flaps of equal length may be disposed on both sides of the bottom side flap along the edge 32. This arrangement would allow the seam of two adjoining panels to terminate in the center of the next panel.

Figure 7:
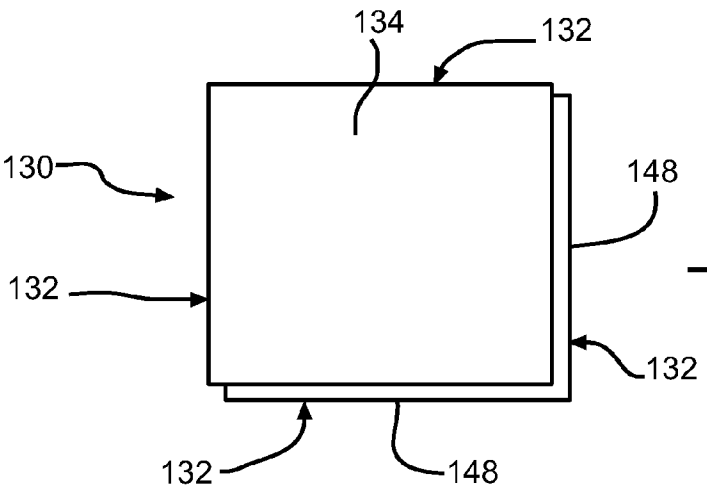
FIG. 7 is a plan view of an alternative embodiment of the interlocking edges of the underlayment panels.
Figure 8:
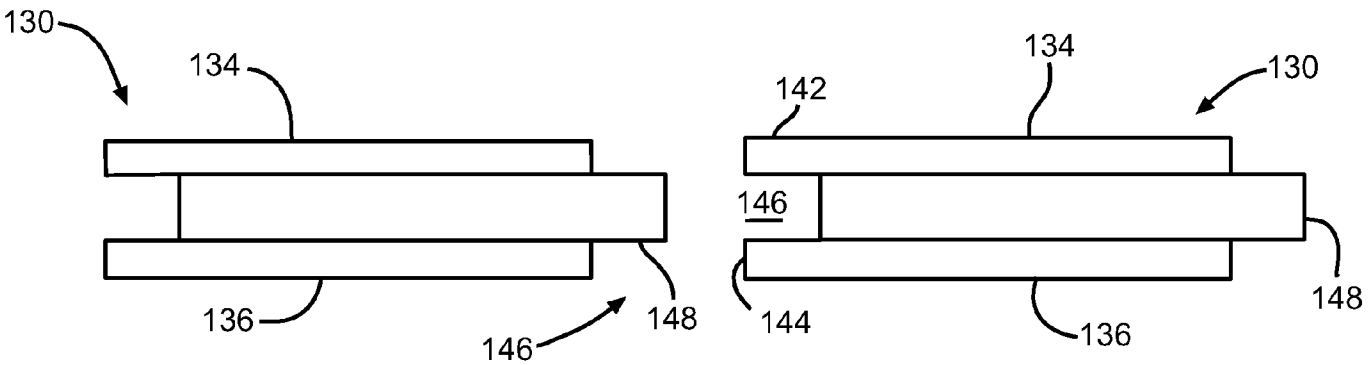
FIG. 8 is an elevation view of the assembly of the interlocking edges of adjacent underlayment panels of FIG. 7.

FIGS. 7 and 8 illustrate an alternative embodiment of the underlayment panels 130, having a plurality of edges 132, a top side 134, a bottom side 136, and flaps configured as tongue and groove structures. The flaps include upper and lower flanges 142, 144 extending from some of the edges 132 of the panels 130, with the upper and lower flanges 142, 144 defining slots 146 extending along the edges 132. An intermediate flange 148 extends from the remainder of the edges of the panels, with the intermediate flange 148 being configured to fit within the slots 146 in a tongue-and-groove configuration. The flanges 148 of one panel 130 fit together in a complementary fashion with the slot 146 defined by the flanges 142, 144 of an adjacent panel. The purpose of the flanges 142, 144, and 148 is to secure the panels against vertical movement relative to each other. When the panels 130 are used in combination with a turf assembly 12, i.e., as an underlayment for the turf assembly, the application of a downward force applied to the turf assembly pinches the upper and lower flanges 142, 144 together, thereby compressing the intermediate flanges 148 between the upper and lower flanges, and preventing or substantially reducing relative vertical movement between adjacent panels 130. The top side 134 may include a textured surface having a profile that is rougher or contoured beyond that produced by conventional smooth surfaced molds and molding techniques, which are known in the art.

Figure 9:
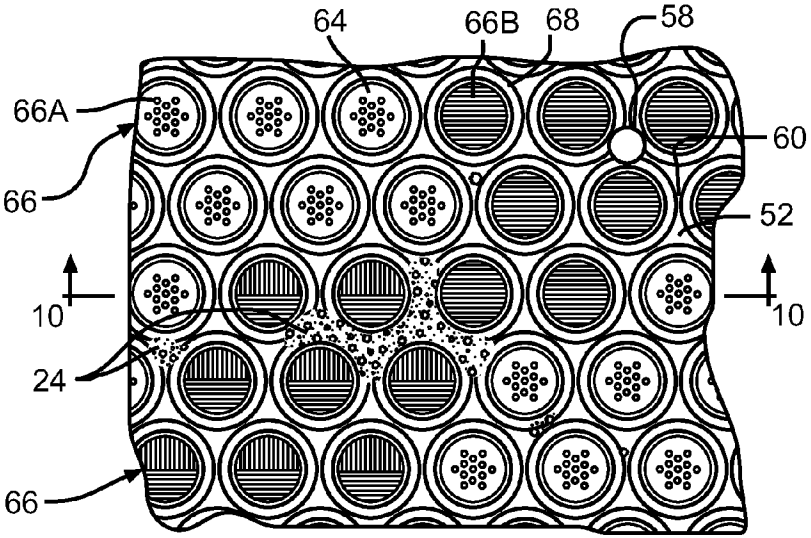
FIG. 9 is an enlarged plan view of an embodiment of a drainage channel and infill trap and a frictional surface of the underlayment panel.
Figure 10:
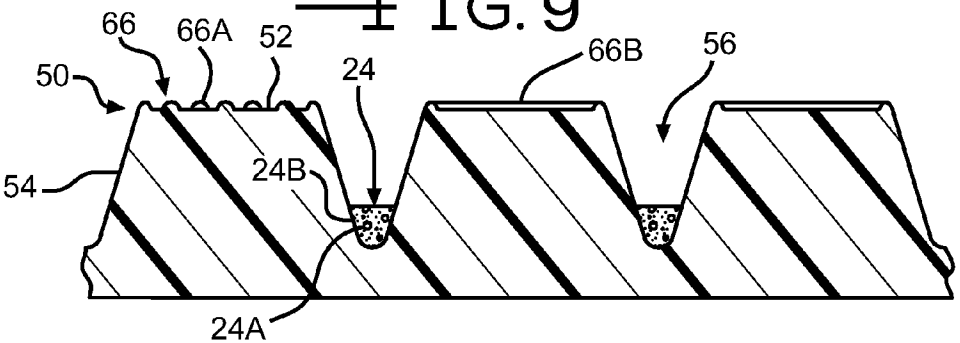
FIG. 10 is an elevation view in cross section of the drainage channel and infill trap of FIG. 9.
Figure 11:
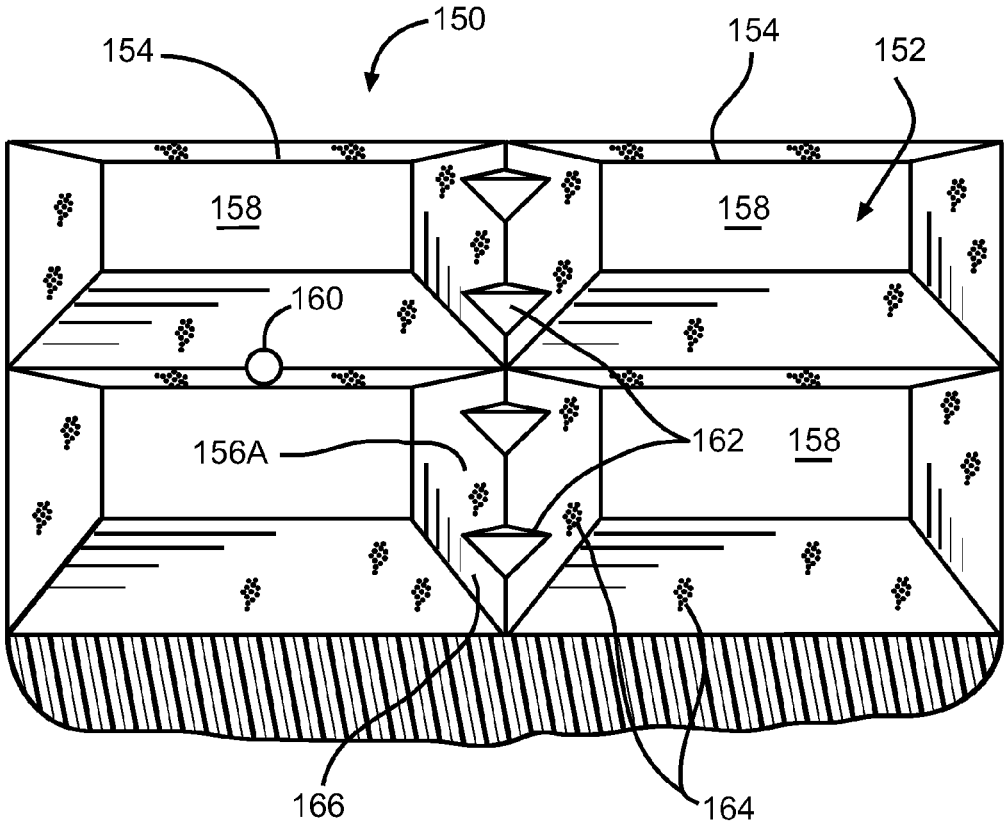
FIG. 11 is a plan view of another embodiment of a frictional surface of the underlayment panel.

FIGS. 1-3 further show a plurality of projections 50 are positioned over the top side 34 of the panels 30. The projections 50 have truncated tops 64 that form a plane that defines an upper support surface 52 configured to support the artificial turf assembly 12. The projections 50 do not necessarily require flat, truncated tops. The projections 50 may be of any desired cross sectional geometric shape, such as square, rectangular, triangular, circular, oval, or any other suitable polygon structure. The projections 50, as shown in FIG. 10, and projections 150 as shown in FIGS. 11 and 12, may have tapered sides 54, 154 extending from the upper support surface 52, 152 outwardly to the top side 34 of the core 35. The projections 50 may be positioned in a staggered arrangement, as shown in FIGS. 2, 6, and 9. The projections 50 may be any height desired, but in one embodiment the projections 50 are in the range of about 0.5 millimeters to about 6 millimeters, and may be further constructed with a height of about 3 millimeters. In another embodiment, the height is in the range of about 1.5 millimeters to about 4 millimeters. The tapered sides 54 of adjacent projections 50 cooperate to define channels 56 that form a labyrinth across the panel 30 to provide lateral drainage of water that migrates down from the turf assembly 12. The channels 56 have drain holes 58 spaced apart and extending through the thickness of the panel 30.

As shown in FIG. 9, the channels 56 may be formed such that the tapered sides 54 substantially intersect or meet at various locations in a blended radii relationship transitioning onto the top surface 34. The projections 50, shown as truncated cone-shaped structures having tapered sides 54, form a narrowed part, or an infill trap 60, in the channel 56. The infill trap 60 blocks free flow of infill material 24 that migrates through the porous backing layer 22, along with water. As shown in FIGS. 9 and 10, the infill material 24 becomes trapped and retained between the tapered sides 54 in the channels 56. The trapping of the infill material 24 prevents excessive migrating infill from entering the drain holes 58. The trapped infill material may constrict or somewhat fill up the channels 56 but does not substantially prevent water flow due to interstitial voids created by adjacent infill particles, 24A and 24B, forming a porous filter.

The size of the drainage holes 58, the frequency of the drainage holes 58, the size of the drainage channels 56 on the top side 34 or the channels 76 on the bottom side 36, and the frequency of the channels 56 and 76 provide a design where the channels can line up to create a free flowing drainage system. In one embodiment, the system can accommodate up to 70 mm/hr rainfall, when installed on field having a slightly-raised center profile, for example, on the order of a 0.5% slope. The slightly-raised center profile of the field tapers, or slopes away, downwardly towards the perimeter. This format of installation on a full sized field promotes improved horizontal drainage water flow. For instance, a horizontal drainage distance of 35 meters and a perimeter head pressure of 175 millimeters.

The cone shaped projections 50 of FIGS. 6 and 9 also form widened points in the channel 56. The widened points, when oriented on the edge 32 of the panel 30, form beveled, funnel-like interfaces or edges 62, as shown in FIG. 6. These funnel edges 62 may be aligned with similar funnel edges on adjacent panels and provide a greater degree of installation tolerance between mating panel edges to create a continuous channel 56 for water drainage. If the top side projections 50 have a non-curved geometry, the outer edge corners of the projections 50 may be removed to form the beveled funnel edge, as will be discussed below in conjunction with bottom side projections. Additionally, the bottom side projections may be generally circular in shape and exhibit a similar spaced apart relationship as that described above. The bottom side projections may further be of a larger size than the top side projections.

Figure 13:
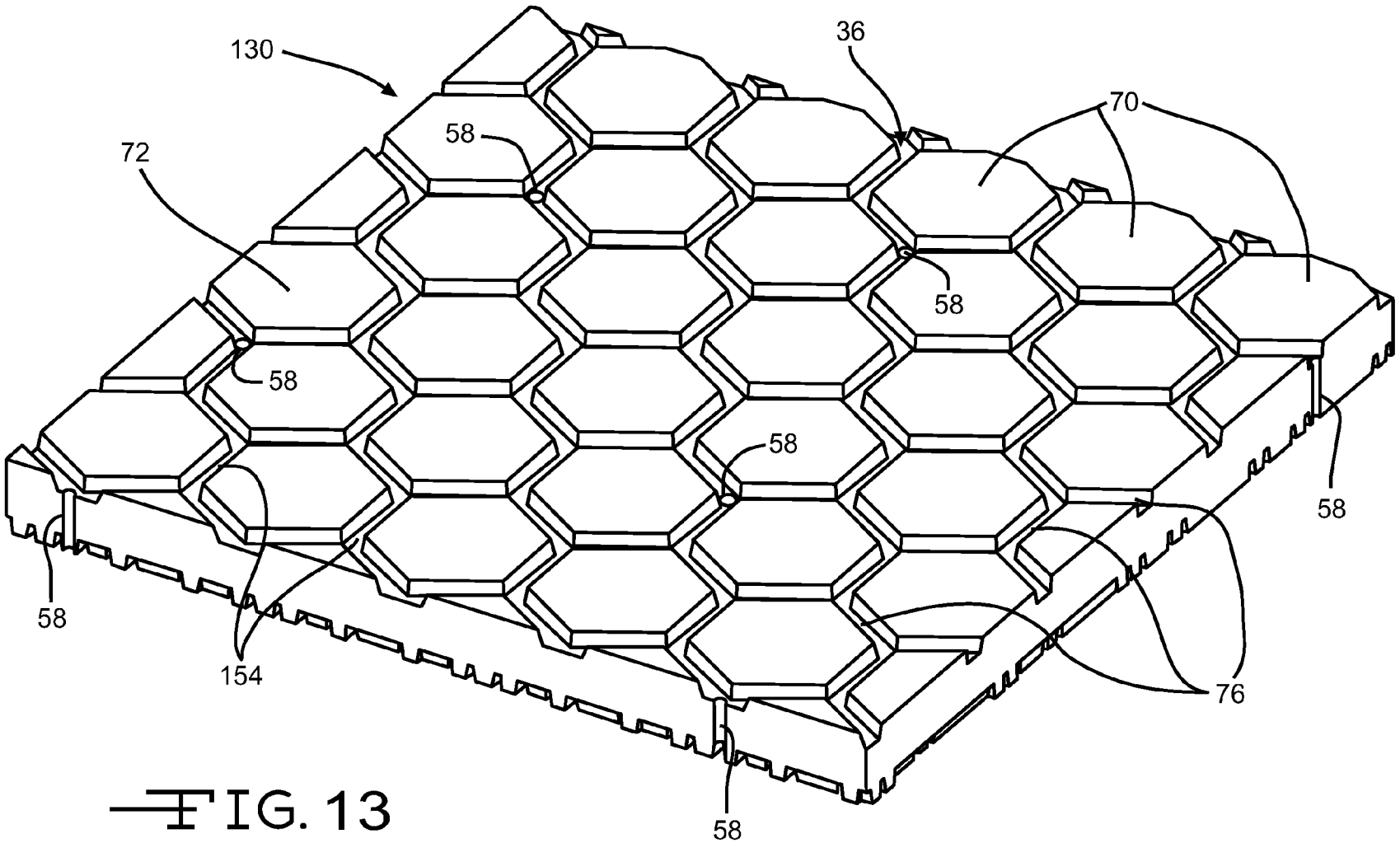
FIG. 13 is a perspective view of an embodiment of a bottom side of the underlayment drainage panel.

A portion of the bottom side 36 of the panel 30 is shown in FIGS. 5 and 13. The bottom side 36 includes the lower support surface 70 defined by a plurality of downwardly extending projections 72 and a plurality downwardly extending edge projections 74. The plurality of projections 72 and edge projections 74 space apart the bottom side 36 of the panel 30 from the foundation layer 16 and further cooperate to define drainage channels 76 to facilitate water flow beneath the panel. The edge projections 74 cooperate to form a funnel edge 78 at the end of the drainage channel 76. These funnel edges 78 may be aligned with similar funnel edges 78 on adjacent panels and provide a greater degree of installation tolerance between mating panel edges to create a continuous channel 76 for water drainage. The bottom side 36 shown in FIG. 13 represents a section from the center of the panel 30. The bottom side projections 72 and edge projections 74 are typically larger in surface area than the top side projections 50 and are shallower, or protrude to a lesser extent, though other relationships may be used. The larger surface area and shorter height of the bottom side projections 72 tends to allow the top side projections 50 to deform more under load. Alternatively, the bottom side projections may be generally circular in shape and exhibit a similar spaced apart relationship as that described above. The bottom side projections may further be of a larger size than the top side projections.

The larger size of the bottom side projections 72 allows them to be optionally spaced in a different arrangement relative to the arrangement of the top side projections 50. Such a non-aligned relative relationship assures that the top channels 56 and bottom channels 76 are not aligned with each other along a relatively substantial length that would create seams or bending points where the panel core 35 may unduly deflect.

Referring again to FIG. 9, the top side projections 50 may include a friction enhancing surface 66 on the truncated tops 64. The friction enhancing surface 66 may be in the form of bumps, or raised nibs or dots, shown generally at 66A in FIG. 9. These bumps 66A provide an increased frictional engagement between the backing layer 22 and the upper support surface of the underlayment panel 30. The bumps 66A are shown as integrally molded protrusions extending up from the truncated tops 64 of the projections 50. The bumps 66A may be in a pattern or randomly oriented. The bumps 66A may alternatively be configured as friction ribs 66B. The ribs 66B may either be on the surface of the truncated tops 64 or slightly recessed and encircled with a rim 68.

FIGS. 11 and 12 illustrate alternative embodiments of various turf underlayment panel sections having friction enhancing and infill trapping surface configurations. A turf underlayment panel 150 includes a top side 152 of the panel 150 provided with plurality of spaced apart, upwardly oriented projections 154 that define flow channels 156 suitable for the flow of water along the top surface of the panel. The projections 154 are shown as having a truncated pyramid shape, however, any suitable shape, such as for example, truncated cones, chevrons, diamonds, squares and the like can be used. The projections 154 have substantially flat upper support surfaces 158 which support the backing layer 22 of the artificial turf assembly 12. The upper support surfaces 158 of the projections 154 can have a generally square shape when viewed from above, or an elongated rectangular shape as shown in FIGS. 11 and 12, or any other suitable shape.

Figures 12A, 12B:
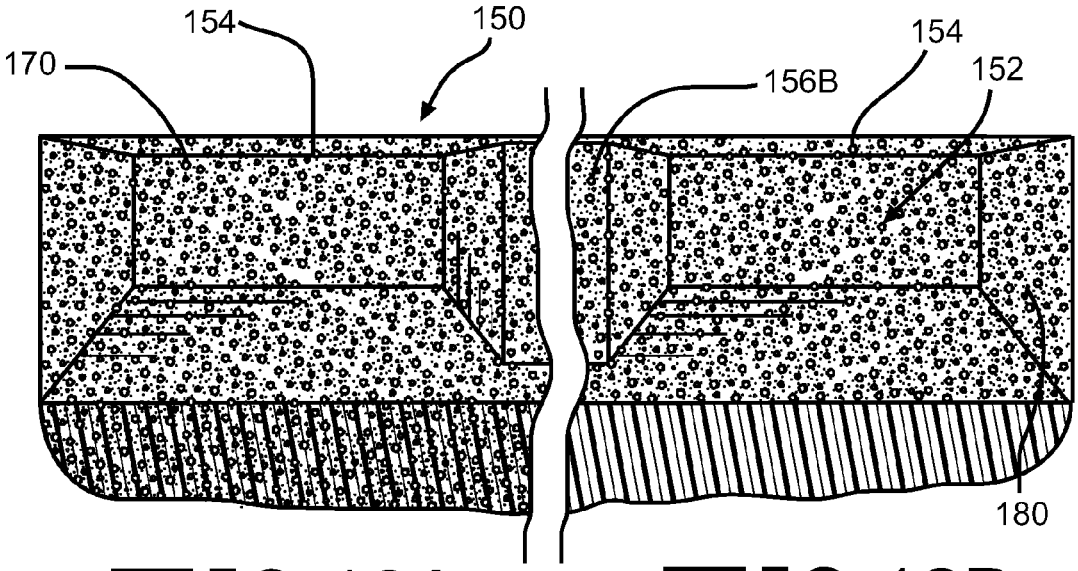
FIG. 12A is a plan view of another embodiment of a frictional surface of the underlayment panel.
FIG. 12B is a plan view of another embodiment of a frictional surface of the underlayment panel.

The frictional characteristics of the underlayment may further be improved by the addition of a medium, such as a grit 170 or other granular material, to the underlayment mixture, as shown in FIGS. 12A and 12B. In an embodiment shown in FIG. 12A, the granular medium is added to the adhesive or glue binder and mixed together with the beads. The grit 170 may be in the form of a commercial grit material, typically provided for non-skid applications, often times associated with stairs, steps, or wet surfaces. The grit may be a polypropylene or other suitable polymer, or may be silicon oxide ($SiO_2$), aluminum oxide ($Al_2O_3$), sand, or the like. The grit 172 however may be of any size, shape, material or configuration that creates an associated increased frictional engagement between the backing layer 22 and the underlayment 150. In operation, the application of grit material 172 to the underlayment layer 14 will operate in a different manner from operation of grit applied to a hard surface, such as pavement or wood. When applied to a hard surface, the non-skid benefit of grit in an application, such as grit filled paint, is realized when shearing loads are applied directly to the grit structure by feet, shoes, or vehicle wheels. Further, grit materials are not applied under a floor covering, such as a rug or carpet runner, in order to prevent movement relative to the underlying floor. Rather, non-skid floor coverings are made of soft rubber or synthetic materials that provide a high shear resistance over a hard flooring surface.

The grit material 170 when applied to the binder agent in the turf underlayment structure provides a positive grip to the turf backing layer 22. This gripping of the backing layer benefits from the additional weight of the infill medium dispersed over the surface, thus applying the necessary normal force associated with the desired frictional, shear-restraining force. Any concentrated deflection of the underlayment as a result of a load applied to the turf will result in a slight momentary "divot" or discontinuity that will change the frictional shear path in the underlayment layer 14. This deflection of the surface topography does not occur on a hard surface, such as a painted floor using grit materials. Therefore, the grit material, as well as the grit binder are structured to accommodate the greater elasticity of the underlayment layer, as opposed toe the hard floor surface, to provide improved surface friction. A grit material 180 may alternatively be applied to the top of the bead and binder mixture, as shown in FIG. 12B, such that the beads within the thickness exhibit little to no grit material 180. In this instance, the grit material 180 would primarily be on top of and impregnated within the top surface and nearby thickness of the underlayment 150. Alternatively, the grit material 180 may be sprinkled onto or applied to the mold surface prior to applying the bead and binder slurry so that the predominant grit content is on the top of the underlayment surface after the product is molded.

Another embodiment provides a high friction substrate, such as a grit or granular impregnated fabric applied to and bonded with the upper surface of the underlayment layer 14, i.e. the top side 34 or the upper support surface 52 as defined by the projections 50. The fabric may alternatively be a mesh structure whereby the voids or mesh apertures provide the desired surface roughness or high friction characteristic. The mesh may also have a roughened surface characteristic, in addition to the voids, to provide a beneficial gripping action to the underlayment. The fabric may provide an additional load spreading function that may be beneficial to protecting players from impact injury. Also the fabric layer may spread the load transfer from the turf to the underlayment and assist in preserving the base compaction characteristic.

FIG. 17 illustrates an alternative embodiment of an underlayment layer having a water drainage structure and turf assembly frictional engagement surface. The underlayment layer 200 includes a top side 210 configured to support the artificial turf assembly 12. The underlayment layer 200 further includes a core 235, a top side 210 and a bottom side 220. The top side 210 includes a plurality of spaced apart projections 230 that define channels 240 configured to allow water flow along the top side 210. The top side 210 includes a series of horizontally spaced apart friction members 250 that are configured to interact with the downwardly oriented ridges 26 on the bottom surface 28 of the backing layer 22 of the artificial turf assembly 12. The friction members 250 engage the ridges 26 so that when the artificial turf assembly 12 is laid on top of the underlayment layer 200 relative horizontal movement between the artificial turf assembly 12 and the underlayment layer 200 is inhibited.

In order to facilitate drainage and infill trapping, the channels 156A defined by the projections 152 optionally can have a V-shaped cross-sectional shape as shown in FIG. 11, with walls that are at an acute angle to the vertical. The flow channels 156B shown in FIG. 12 are slightly different from flow channels 156A since they have a flattened or truncated V-shaped cross-sectional shape rather than the true V-shaped cross-section of channels 156A. The purpose of the flow channels 156A and 156B is to allow water to flow along the top side 152 of the panels 150. Rain water on the turf assembly 12 percolates through the infill material 24 and passes though the backing layer 22. The flow channels 156A, and 156B allow this rain water to drain away from the turf system 10. As the rain water flows across the top side 152 of the panel 150, the channels 156A and 156B will eventually direct the rainwater to a vertical drain hole 160. The drain holes 160 then allow the rain water to drain from the top side 152 to the bottom side of the turf underlayment layer 14. The drain hole 160 can be molded into the panel, or can be mechanically added after the panel is formed.

During the operation of the artificial turf system 10, typically some of the particles of the infill material 24 pass through the backing layer 22. These particles can flow with the rain water along the channels 156A and 156B to the drain holes 160. The particles can also migrate across the top surface 152 in dry conditions due to vibration from normal play on the turf system 10. Over time, the drain holes 160 can become clogged with the sand particles and become unable to drain the water from the top surface 152 to the bottom surface. Therefore it is advantageous to configure the top surface 152 to impede the flow of sand particles within the channels 156A, 156B. Any suitable mechanism for impeding the flow of infill particles along the channels can be used.

In one embodiment, as shown in FIG. 11, the channel 156A contains dams 162 to impede the flow of infill particles. The dams 162 can be molded into the structure of the turf underlayment layer 14, or can be added in any suitable manner. The dams 162 can be of the same material as the turf underlayment layer, or of a different material. In another embodiment, the flow channels 156A are provided with roughened surfaces 164 on the channel sidewalls 166 to impede the flow of infill particles. The roughened surface traps the sand particles or at least slows them down.

FIGS. 14-16 illustrate the dynamic load absorption characteristics of projections, shown in conjunction with the truncated cone projections 50 of the underlayment 30. The projections 50 on the top side provide a dynamic response to surface impacts and other load inputs during normal play on athletic fields. The truncated geometric shapes of the protrusions 50 provide the correct dynamic response to foot and body impacts along with ball bounce characteristics. The tapered sides 54 of the projections 50 incorporate some amount of taper or "draft angle" from the top side 34, at the base of the projection 50, to the plane of the upper support surface 52, which is substantially coplanar with the truncated protrusion top. Thus, the base of the projection 50 defines a somewhat larger surface area than the truncated top surface area. The drainage channels 56 are defined by the tapered sides 54 of adjacent projections 50 and thereby establish gaps or spaces therebetween.

FIG. 14 illustrates the free state distance 90 of the projection 50 and the free state distance 92 of the core 35. The projections 50 deflect when subjected to an axially applied compressive load, as shown in FIG. 15. The projection 50 is deflected from the projection free state 90 to a partial load deflection distance 94. The core 35 is still substantially at or near a free state distance 92. The channels 56 allow the projections to deflect outwardly as an axial load is applied in a generally downward direction. The relatively unconstrained deflection allows the protrusions 50 to "squash" or compress vertically and expand laterally under the compressive load or impact force, as shown in FIG. 15. This relatively unconstrained deflection may cause the apparent spring rate of the underlayment layer 14 to remain either substantially constant throughout the projection deflection or increase at a first rate of spring rate increase.

Continued deformation of the protrusions 50 under a compressive or impact load, as shown in FIG. 16, causes the projections 50 to deform a maximum amount to a fully compressed distance 96 and then begin to deform the core 35. The core 35 deforms to a core compression distance 98 which is smaller than the core free state distance 92. As the core 35 deforms, the apparent spring rate increases at a second rate, which is higher than the first rate of spring rate increase. This rate increase change produces a stiffening effect as a compressively-loaded elastomer spring. The overall effect also provides an underlayment behavior similar to that of a dual density material. In one embodiment, the material density range is between 45 grams per liter and 70 grams per liter. In another embodiment, the range is 50 grams per liter to 60 grams per liter. Under lower compression or impact loads, the projections 50 compress and the underlayment 30 has a relatively low reaction force for a relatively large deflection, thus producing a relatively low hardness. As the compression or impact force increases, the material underlying the geometric shape, i.e. the material of the core, creates a larger reaction force without much additional deformation, which in turn increases the stiffness level to the user.

The ability to tailor the load reactions of the underlayment and the turf assembly as a complete artificial turf system allows adjustment of two competing design parameters, a bodily impact characteristic and an athletic response characteristic. The bodily impact characteristic relates to the turf system's ability to absorb energy created by player impacts with the ground, such as, but not limited to, for example tackles common in American-style football and rugby. The bodily impact characteristic is measured using standardized testing procedures, such as for example ASTM-F355 in the U.S. and EN-1177 in Europe. Turf systems having softer or more impact absorptive responses protect better against head injury, but offer diminished or non-optimized athlete and ball performance. The athletic response characteristic relates to athlete performance responses during running and can be measured using a simulated athlete profile, such as the Berlin Artificial Athlete. Athlete performance responses include such factors as turf response to running loads, such as heel and forefoot contact and the resulting load transference. The turf response to these running load characteristics can affect player performance and fatigue. Turf systems having stiffer surface characteristics may increase player performance, such as running load transference, (i.e. shock absorption, surface deformation and energy restitution), and ball behavior, but also increase injury potential due to lower impact absorption. The underlayment layer and the turf assembly each has an associated energy absorption characteristic, and these are balanced to provide a system response appropriate for the turf system usage and for meeting the required bodily impact characteristics and athletic response characteristics.

In order to accommodate the particular player needs, as well as satisfying particular sport rules and requirements, several design parameters of the artificial turf system may need to be varied. The particular sport, or range of sports and activities undertaken on a particular artificial turf system, will dictate the overall energy absorption level required of the system. The energy absorption characteristic of the underlayment layer may be influenced by changes in the material density, protrusion geometry and size, panel thickness and surface configuration. These parameters may further be categorized under a broader panel material factor and a panel geometry factor of the underlayment layer. The energy absorption characteristic of the turf assembly may be subject to considerations of infill material and depth. The infill material comprises a mixture of sand and synthetic particulate in a ratio to provide proper synthetic grass blade exposure, water drainage, stability, and energy absorption.

The turf assembly 12 provides a lot of the impact shock attenuation for safety for such contact sports as American football. The turf assembly 12 also provides the feel of the field when running, as well as ball bounce and roll in sports such as soccer (football), field hockey, rugby and golf. The turf assembly 12 and the turf underlayment layer 14 work together to get the right balance for hardness in running, softness (impact absorption or energy absorption) in falls, ball bounce and roll, etc. To counteract the changing field characteristics over time, which affect ball bounce and the roll and feel of the field to the running athlete, in some cases the infill material may be maintained or supplemented by adding more infill, and by using a raking machine or other mechanism to fluff up the infill so it maintains the proper feel and impact absorption.

The hardness of the athletic field affects performance on the field, with hard fields allowing athletes to run faster and turn more quickly. This can be measured, for example in the United States using ASTM F1976 test protocol, and in the rest of the world by FIFA, IRB (International Rugby Board), FIH (International Hockey Federation), and ITF (International Tennis Federation) test standards. In the United States, another characteristic of the resilient turf underlayment layer 14 is to provide increased shock attenuation of the infill turf system by up to 20 percent during running heel and running forefoot loads. A larger amount of attenuation may cause athletes to become too fatigued, and not perform at their best. It is generally accepted that an athlete cannot perceive a difference in stiffness of plus or minus 20 percent deviations over a natural turf stiffness at running loads based on the U.S. tests. The FIFA test requirement has minimum and maximum values for shock attenuation and deformation under running loads for the complete turf/underlayment system. Artificial turf systems with shock attenuation and deformation values between the minimum and maximum values simulate natural turf feel.

The softness for impact absorption of an athletic field to protect the players during falls or other impacts is a design consideration, particularly in the United States. Softness of an athletic field protects the players during falls or other impacts. Impact energy absorption is measured in the United States using ASTM F355-A, which gives a rating expressed as Gmax (maximum acceleration in impact) and HIC (head injury criterion). The head injury criterion (HIC) is used internationally. There may be specific imposed requirements for max acceleration and HIC for athletic fields, playgrounds and similar facilities.

The turf assembly is advantageous in that in one embodiment it is somewhat slow to recover shape when deformed in compression. This is beneficial because when an athlete runs on a field and deforms it locally under the shoe, it is undesirable if the play surface recovers so quickly that it "pushes back" on the shoe as it lifts off the surface. This would provide unwanted energy restoration to the shoe. By making the turf assembly 12 have the proper recovery, the field will feel more like natural turf which doesn't have much resilience. The turf assembly 12 can be engineered to provide the proper material properties to result in the beneficial limits on recovery values. The turf assembly can be designed to compliment specific turf designs for the optimum product properties.

The design of the overall artificial turf system 10 will establish the deflection under running loads, the impact absorption under impact loads, and shape of the deceleration curve for the impact event, and the ball bounce performance and the ball roll performance. These characteristics can be designed for use over time as the field ages, and the infill becomes more compacted which makes the turf layer stiffer.

The panels 30 are designed with optimum panel bending characteristics. The whole panel shape is engineered to provide stiffness in bending so the panel doesn't bend too much when driving over it with a vehicle while the panel is lying on the ground. This also assists in spreading the vehicle load over a large area of the substrate so the contour of the underlying foundation layer 16 won't be disturbed. If the contour of the foundation layer 16 is not maintained, then water will pool in areas of the field instead of draining properly.

In one embodiment of the invention, an artificial turf system for a soccer field is provided. First, performance design parameters, related to a system energy absorption level for the entire artificial turf system, are determined for the soccer field. These performance design parameters are consistent according to the FIFA (Federation Internationale de Football Association) Quality Concept for Artificial Turf, the International Artificial Turf Standard (IATS) and the European EN15330 Standard. Typical shock, or energy, absorption and deformation levels from foot impacts for such systems are within the range of 55-70% shock absorption and about 4 millimeters to about 9 millimeters deformation, when tested with the Berlin Artificial Athlete (EN14808, EN14809). Vertical ball rebound is about 60 centimeters to about 100 centimeters (EN 12235), Angled Ball Behavior is 45-70%, Vertical Permeability is greater than 180 mm/hr (EN 12616) along with other standards, such as for example energy restitution. Other performance criteria may not be directly affected by the underlayment performance, but are affected by the overall turf system design. The overall turf system design, including the interactions of the underlayment may include surface interaction such as rotational resistance, ball bounce, slip resistance, and the like. In this example where a soccer field is being designed, a performance level for the entire artificial turf system for a specific standard is selected. Next, the artificial turf assembly is designed. The underlayment performance characteristics selected will be complimentary to the turf assembly performance characteristics to provide the overall desired system response to meet the desired sports performance standard. It is understood that the steps in the above example may be performed in a different order to produce the desired system response.

In general, the design of the turf system having complimentary underlayment and turf assembly performance characteristics may for example provide a turf assembly that has a low amount of shock absorption, and an underlayment layer that has a high amount of shock absorption. In establishing the relative complimentary performance characteristics, there are many options available for the turf design such as pile height, tufted density, yarn type, yarn quality, infill depth, infill types, backing and coating. For example, one option would be to select a low depth and/or altered ratio of sand vs. rubber infill, or the use of an alternative infill material in the turf assembly. If in this example the performance of the turf assembly has a relatively low specific shock absorption value, the shock absorption of the underlayment layer will have a relatively high specific value.

By way of another example having different system characteristics, an artificial turf system for American football or rugby may provide a turf assembly that has a high amount of energy absorption, while providing the underlayment layer with a low energy absorption performance. In establishing the relative complimentary energy absorption characteristics, selecting a high depth of infill material in the turf assembly may be considered. Additionally, where the energy absorption of the turf assembly has a value greater than a specific value, the energy absorption of the underlayment layer will have a value less than the specific value.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A turf underlayment layer having panels including a top side having a plurality of projections, a bottom side having a plurality of projections, and panel edges, the plurality of top side projections forming top side channels and the bottom side projections forming bottom side channels, the panel edges configured to abut edges of adjacent panels, the panels further including a plurality of drain holes dispersed over the panel surfaces for fluid communication between the top side and the bottom side of the panel, the drain holes positioned to intersect both the top side and bottom side channels to connect the top side channels to the bottom side channels, wherein the panels are made from a plurality of polyolefin beads, the plurality of polyolefin beads bonded together by at least one of pressure and heat to produce a substantially water-impervious surface.

2. The underlayment layer of claim 1 wherein the top side projections and bottom side projections terminate in generally flat support surfaces having different sized support surface areas, the top side projections and bottom side projections being spaced apart and sized such that the top side channels intersect with the bottom side channels at the drain holes.

3. The underlayment layer of claim 2 wherein the support surfaces of the top side projections are truncated cones having a friction enhancing surface configured as one of bumps, raised nibs, ribs, and dots.

4. The underlayment layer of claim 3 wherein the friction enhancing surface is a plurality of raised dots that are recessed and encircled with a rim.

5. The underlayment layer of claim 2 wherein the underlayment layer supports an artificial turf assembly that includes infill constituent particles and the top side channels impede the flow of infill constituent particles along the upper surface.

6. The underlayment layer of claim 5 wherein the top side channels include one of a dam and a roughened surface texture to impede the flow of infill constituent particles.

7. The underlayment layer of claim 5 wherein the top side projections have tapered sides that form the top side channels, the projections being arranged in a relatively spaced-apart relationship such that the channels form a narrowed part between adjacent projections, with the narrowed part functioning to impede the flow of infill constituent particles.

8. The underlayment layer of claim 1 wherein the bottom side projections have a larger surface area and a shorter projection height than the top side projections such that the top side projections deform more under load and return to a substantially similar condition at a slower rate than the bottom side projections.

9. The underlayment layer of claim 1 wherein the top side channels and bottom side channels accommodate up to 70 mm/hr rainfall on slope of about 0.5%.

10. The underlayment layer of claim 9 wherein the top and bottom side channels cooperate to provide about a 35 meter horizontal drainage distance and at least about a 175 millimeter perimeter head pressure.

11. The underlayment layer of claim 8 wherein the panels support an artificial turf assembly and the panel includes a core section between the top side projections and the bottom side projections, the top side projections defining a first deformation characteristic associated with an athletic response characteristic and the core defining a second deformation characteristic associated with a bodily impact characteristic, the first and second deformation characteristics being complimentary to provide a turf system bodily impact characteristic and a turf system athletic response characteristic.

12. The underlayment layer of claim 11 wherein the turf system athletic response characteristic provides a turf system shock attenuation of between 60% and 70% of the artificial turf system during running heel and running forefoot loads.

13. The underlayment layer of claim 12 wherein the second deformation characteristic provides an impact energy absorption sufficient to establish a head injury criteria of less than 1000.

14. The underlayment layer of claim 11 where the first deformation characteristic is responsive to a panel thickness and a molded material density.

15. The underlayment layer of claim 14 where the panel thickness is in a range of 20-30 millimeters and the molded material density is in a range of 50-70 grams per liter.

16. The underlayment layer of claim 15 wherein the top side channels and bottom side channels accommodate up to 70 mm/hr rainfall on a slope of about 0.5%.

17. The underlayment layer of claim 15 wherein the top and bottom side channels cooperate to provide about a 35 meter horizontal drainage distance and at least about a 175 millimeter perimeter head pressure.

18. A turf underlayment layer having panels including a top side having a plurality of projections, a bottom side having a plurality of projections, the top side projections and bottom side projections terminating in generally flat support surfaces having different sized support surface areas, and panel edges, the plurality of top side projections forming top side channels and the bottom side projections forming bottom side channels, the panel edges abutting edges of adjacent panels, the panels further including a plurality of drain holes dispersed over the panel surfaces for fluid communication between the top side and the bottom side of the panel, the top side projections and bottom side projections being spaced apart and sized such that the top side channels intersect with the bottom side channels at the drain holes, the drain holes positioned to intersect both the top side and bottom side channels to connect the top side channels to the bottom side channels, the top side channels including a roughened surface texture.

19. The turf underlayment layer of claim 18 wherein the roughened surface texture is formed from a plurality of raised dots positioned on the top side channel.

20. The turf underlayment layer of claim 19 wherein the panels are formed from a molded, expanded bead polyolefin material.

21. The turf underlayment layer of claim 20 wherein the panels have a thickness in a range of 20-30 millimeters.

22. The turf underlayment layer of claim 20 wherein the panels have a molded material density in a range of 50-70 grams per liter.

23. The turf underlayment layer of claim 22 wherein the polyolefin material is one of a polyethylene material and a polypropylene material.

24. The turf underlayment layer of claim 18 wherein the top side projections have a smaller surface area than the bottom side projections.

* * * * *